United States Patent [19]

Saupe

[11] 3,975,146

[45] Aug. 17, 1976

[54] FIXING THERMOPLASTIC MATERIAL ON A CARRIER

[75] Inventor: Wolfram Saupe, Mammolshain, Taunus, Germany

[73] Assignee: Hoechst Aktiengesellschaft, Frankfurt, Germany

[22] Filed: Feb. 10, 1975

[21] Appl. No.: 548,789

Related U.S. Application Data

[63] Continuation of Ser. No. 315,799, Dec. 18, 1972, abandoned.

[30] Foreign Application Priority Data

Dec. 20, 1971 Germany ..... 2163136

[52] U.S. Cl. ..... 432/59; 126/247; 156/73.5; 156/583; 219/216; 219/388

[51] Int. Cl.[2] ..... F27B 9/28

[58] Field of Search ..... 219/469, 460, 530, 531, 219/388 C, 388 W, 216; 432/60, 228, 246, 59; 156/73.5, 583; 126/247

[56] References Cited

UNITED STATES PATENTS 3,219,799 11/1965 Trumbull et al. ..... 219/388 W 3,357,401 12/1967 Wood ..... 432/60

*Primary Examiner*—Edward G. Whitby

*Attorney, Agent, or Firm*—Stevens, Davis, Miller & Mosher

[57] ABSTRACT

A process and apparatus for heat-fixing a heat-fixable material to a carrier in which process the heat is generated by contact between the side of the carrier face from the material and a friction element during relative motion of the carrier and the element. The apparatus includes a friction roller or belt around which the carrier is partly wrapped and which can be rotated relative to the carrier by a driving motor. The roller may comprise a material or low heat conductivity having a thin wall with the interior being filled with insulating material. The apparatus also may include a probe for measuring the temperature of the carrier material in or immediately after contact with the friction element.

6 Claims, 2 Drawing Figures

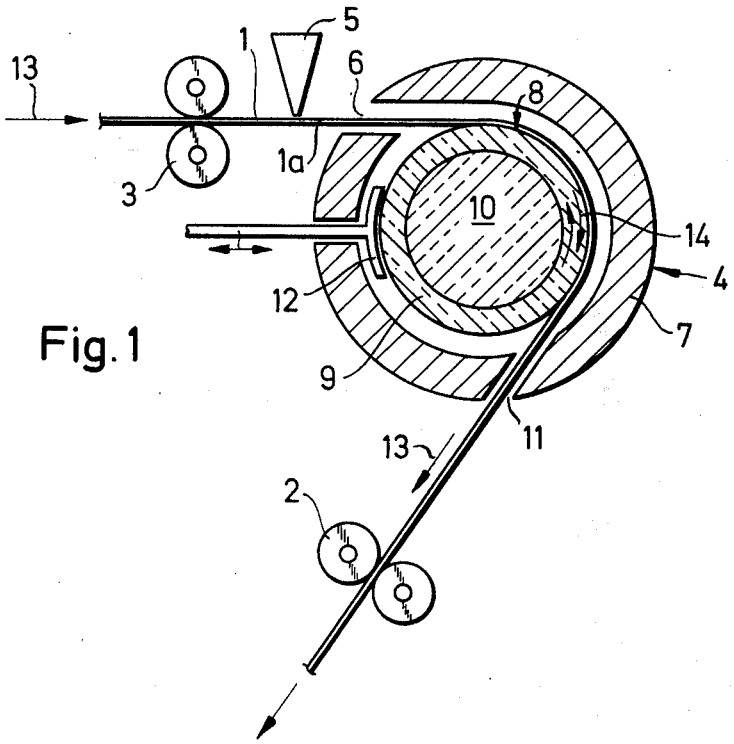
Fig. 1
Fig. 2
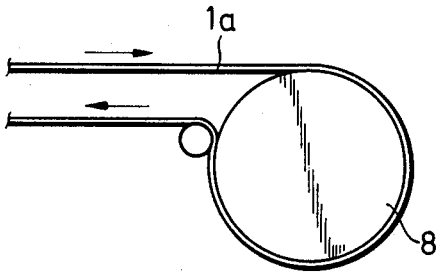

FIXING THERMOPLASTIC MATERIAL ON A CARRIER

This is a continuation of application Ser. No. 315,799, filed Dec. 18, 1972 now abandoned.

The present invention relates to a process and apparatus for fixing heat-fixable material on a carrier.

In the production of non-smudging copies in an electrophotographic machine, it is required to fix heat-fixable material onto a carrier by application of heat. This process, that is, fixing thermoplastic material onto another carrier by means of heat, is also necessary in other fields of industry (paper lamination and the like), but for simplicity in this specification, heat fixing will be discussed especially in relation to electro-photographic processes.

In electro-photographic processes, toner images are fixed onto a copy carrier by heating the toner material to above the melting point of the thermoplastic constituents. In this way the toner particles are fused onto the carrier and fixed on to it.

Many different processes have already been disclosed for effecting this fixing. In one method, heat is transferred to the toner particles by convection, for example by moving heated air over the toner image which is to be fixed (U.S. Pat. No. 3,219,799). This method of heat transfer suffers from the great disadvantage that the heat transfer is poor and that therefore long treatment times are necessary. Furthermore, the fixing apparatus occupies a large space. This in turn results in high heat losses and in particular the heating-up time is considerably extended, which is undesirable particularly for high speed electrophotographic machines.

A further process for fixing the toner particles consists of irradiating the toner image (British Pat. No. 1,185,687). Irradiation processes generally suffer from the disadvantage that because of the low amount of heat released the radiator itself must in most cases be operated far above the ignition point of the carrier material. This involves a considerable fire hazard if there are breakdowns in the movement of the carrier material. This fire hazard can only be reduced by expensive safety devices. In the case of infra-red radiators, a further factor is an undesirably long heating-up time. If these radiators are kept at a temperature near the operating temperature between fixing sequences, considerable power consumption is required for this purpose.

Various fixing processes also have already been proposed in which the heat transfer is effected by heat conduction. Thus in British Pat. No. 1,192,444 it is proposed to pass the carrier material with the toner image through a metal bath. However, an undesirably high energy consumption is required in this process for heating the material, the heating-up time is long and the apparatus is extremely prone to break down.

Finally, fixing processes have also already been proposed in which the carrier material is passed over heated surfaces or between heated rollers (cf. for example, German Offenlegungsschrift Nos. 1,956,160 and 1,937,039). In these processes, the energy required for fixing is supplied to the fixing rollers or fixing surfaces by heat radiation, heat flow, heat conduction or an appropriate combination of such methods. Hence, these processes always suffer from the disadvantages of long heating-up times, high energy consumption for maintaining a ready-to-use condition, large volume apparatus, considerable heat storage capacities and high electric power ratings.

The present invention provides a fixing process which largely avoids the disadvantages mentioned and which has a low space requirement, low tendency to break down and rapid attainment of the ready-to-use condition of an electro-photographic machine operating in accordance with the process.

According to the present invention, there is provided a process for heat-fixing a heat-fixable material to a carrier in which the heat is generated by contact between the side of the carrier free from the material and a friction element during relative motion of the carrier and the element.

The relative motion may, for example, be achieved by moving the carrier over a stationary element, by moving the element and carrier in opposite directions, or by moving them in the same direction, the element moving considerably faster than the carrier. The element may also or alternatively be arranged to move in a direction at right angles to the carrier. If desired the element may be preheated, for example by friction, before contact with the carrier.

The process of the present invention has the advantage that the fixing heat is generated immediately at the surface of the carrier. This reduces the heat loss to a minimum, the energy requirement is minimized, fire hazard is reduced, and an apparatus for carrying out the process can be constructed in a simple manner.

The apparatus which is preferred accordng to the present invention for carrying out the process has a friction roller round which the carrier is partly wrapped, and which can be rotated, relative to the carrier, by a drive device. Either a friction roller having a rough surface which does not destroy the carrier however, or, preferably, a smooth surface may be used. If the friction roller consists of a material of low heat conductivity, for example, alloy steel, ceramics, glass or similar material, and is constructed as a hollow body of low wall thickness, the interior space of which is made heat-insulating, the heat of friction generated is very largely passed through the carrier to the material, for example, toner, which is to be fused.

As can be seen, in the process according to the present invention heat is generated in situ and, if desired, is only generated when the carrier material is in contact with the friction element. Depending on the nature of the carrier material, and especially its tensile strength, the roller can be rotated in various directions in the apparatus according to the present invention. For a given rate of carrier travel, speed and direction of revolution of the friction roller determine the amount of heat generated and transferred to the toner. Hence, apparatus according to the present invention can, without difficulty, be regulated automatically by using a temperature probe and controlling the speed of revolution of the friction roller. The probe may be located in a fixed position in the vicinity of the heated carrier to measure the temperature of the carrier material in, or immediately after, contact with the friction element. The apparatus also may include a probe in the vicinity of the friction element surface for measuring the temperature of the friction element surface and a control device, regulated by the temperature probe for the speed of rotation or speed of travel of the friction element.

The losses through heat convection into the surrounding atmosphere can be kept very low by means of an insulating case which surrounds the friction roller and possesses slits for the passage of the carrier material.

The advantages achieved by the process according to the present invention and by the apparatus indicated for carrying out this process are in particular the following: the heat is generated directly at the point where it is required and there are therefore practically no problems of heat transfer to the user. Furthermore, only the amount of heat which is required to fix the thermoplastic material is generated. The heat losses are extremely low and the heating-up times are short. The power rating of the machine may be considerably reduced. The constructional volume of the apparatus is very low and the heat capacity is small compared to known processes and apparatus.

The invention will now be explained in further detail by way of example only and with reference to the accompanying drawings.

In the drawings,

FIG. 1 shows a schematic cross-section of one embodiment of apparatus for carrying out a process according to the present invention, and FIG. 2 shows a schematic representation of a further embodiment wherein the carrier material has a larger wrap-round angle about the friction element.

Referring now to the drawings, and especially to FIG. 1, a carrier material 1 is passed between a pair of draw rollers 2 and a pair of brake rollers 3 through a fixing station indicated generally by reference numeral 4. The carrier material 1, for example paper, is provided with toner, by means of a device or station 5. The device or station 5 can be a cascade or magnetic brush developing station of an electro-photographic process. In particular, however, the station 5 also can be a transfer station in which a toner image is transferred from the photo-conductor onto the carrier material 1. The carrier material 1a provided with the toner image passes through a slit 6 into the interior of an insulating case 7 and wraps round a friction roller 8. The wrap-round angle is appropriately in the range of about 45° to 270° and in FIG. 1 is 120°. The friction roller 8 has a jacket 9 of, for example, ceramic material, glass or a metal alloy of poor heat conductivity. If required, the roller jacket 9 may have slits or grooves for removing an air layer produced between the roller surface and the carrier material. A heat insulation 10 can be provided in the interior of the roller jacket 9. The roller 8 may be provided with a reversible drive means (not shown). Preferably, the length of the roller 8 is slightly greater than the width of the carrier 1. The carrier material 1 carrying the fixed thermoplastic material leaves the fixing station 4 through a slit 11. A radially movable friction surface 12 is provided inside the insulation. The fixing process takes place as follows:

Initially, the carrier material, in the rest position, is spaced from the friction roller 8. In order that the fixing can take place immediately at the start of the movement of the carrier 1 in the direction of the arrow 13, the roller 8 is brought to the operating speed of revolution and the friction surface 12 is pressed against the roller. As a result, the roller surface is rapidly heated to the operating temperature. The carrier material 1 can now be brought from the position shown in FIG. 1 into intimate contact with the rapidly rotating friction roller, by causing the draw rollers 2 and brake rollers 3 to move. The frictional heat generated between the friction roller 8 and the carrier material 1a is so great that the toner present on the carrier material 1a is fused onto the latter.

In a modification, not shown, the roller 8 may be replaced by a revolving friction belt, driven by drive elements along guides, the carrier being in contact over any desired section of the belt.

Apparatus as shown in FIG. 1 was operated with a carrier material 1 consisting of paper of gauge 80 g/m². In two different experiments, the diameter of the friction roller 8 was in one case 3 cm and in the other case 20 cm, the corresponding speeds of rotation in the direction of the arrow 14 being 10,000 and 2,000 revolutions per minute, respectively. The linear speed of the paper in the direction of the arrow 13 was about 10 and 25cm/second, respectively. The wrap-round angle was 60° to 90° in the first case and 180° in the second case. At the station 5, toner material was fed onto the paper web. The toner material was fixed extremely well onto the paper and could not be wiped off.

A further embodiment of the invention is shown schematically in FIG. 2. Here, the carrier material 1a provided with the material to be fixed is wrapped round about 270° of the friction roller 8. This greater wrap-round angle has the advantage that the path along which the fixing can take place is very much greater than in the case of the smaller wrap-round angle. Such a greater wrap-round angle is of particular advantage for thicker and thermally more insulating carrier materials and for high speed apparatus.

What is claimed is:

1. An apparatus for heat-fixing a heat fixable material to a carrier material comprising an insulating housing having a slit therein through which passes the carrier material, means to move said material through said housing at one speed, a friction roller positioned within said housing about which said carrier material is passed, a movable friction element contactable with said friction roller for creating heat on the surface of said roller at a location where said carrier material does not pass about said roller and means to drive said roller at a speed different from the speed of said material.

2. The apparatus according to claim 1 wherein the friction roller has a jacket of material with low heat conductivity.

3. The apparatus according to claim 2 wherein the friction roller is a cylinder of low wall thickness provided with a heat insulation in the interior of the roller jacket.

4. The apparatus according to claim 2 wherein said jacket has slits or grooves for removing an air layer produced between the roller surface and the carrier material.

5. The apparatus according to claim 1 wherein said insulating housing has a further slit therein through which said carrier material exits and said carrier material is in contact with said roller through a contact angle of from 95° to 270°.

6. The apparatus according to claim 1 wherein said material moving means include draw and brake rollers positioned beyond the exit and before the entrance respectively of said housing whereby the carrier material may be spaced from said roller in a position of rest.

* * * * *